US005262700A

United States Patent [19]

Nilssen

[11] Patent Number: 5,262,700

[45] Date of Patent: Nov. 16, 1993

[54] FLUORESCENT LIGHTING MEANS

[76] Inventor: Ole K. Nilssen, Caesar Dr., Barrington, Ill. 60010

[21] Appl. No.: 816,534

[22] Filed: Dec. 30, 1991

Related U.S. Application Data

[63] Continuation of Ser. No. 379,678, Jul. 13, 1989, abandoned, which is a continuation of Ser. No. 762,769, Aug. 5, 1985, abandoned, which is a continuation-in-part of Ser. No. 346,756, Feb. 8, 1982, abandoned.

[51] Int. Cl.[5] ..... H05B 37/00

[52] U.S. Cl. ..... 315/223; 315/62; 315/224; 315/DIG. 2; 315/DIG. 5; 362/368

[58] Field of Search ..... 315/57, 62, 58, 94, 315/223, 224, DIG. 2, DIG. 5; 362/260, 368

[56] References Cited

U.S. PATENT DOCUMENTS 3,996,493 12/1976 Davenport et al. ..... 315/58
4,262,327 4/1981 Kovacik et al. ..... 362/368
4,293,799 10/1981 Roberts ..... 315/223

*Primary Examiner*—Robert J. Pascal

[57] ABSTRACT

A special fluorescent lamp is provided with its own built-in cathode heating means and is operable to be properly ballasted by way of a light-weight two-wire power cord coming from a special power plug that comprises a built-in high-frequency ballasting means. This special power plug is suitable for being plugged into, held by, and powered by any ordinary household electric power receptacle. The combination of the special fluorescent lamp and the special power plug constitutes a product similar to the so-called bright-stick marketed by General Electric.

13 Claims, 2 Drawing Sheets

FLUORESCENT LIGHTING MEANS

This application is a continuation of application Ser. No. 07/379,678 filed Jul. 13, 1989 and now abandoned, which is a continuation of application Ser. No. 06/762,769 filed Aug. 5, 1985 and now abandoned, which is a Continuation-in-Part of application Ser. No. 06/346,756 filed Feb. 8, 1982 and now abandoned.

BACKGROUND OF THE INVENTION

1. Field of the Invention

The present invention relates to fluorescent lamps that operate on high-frequency current-limited electric power as provided by way of frequency converter means connected with a regular household electric receptacle.

2. Description of Prior Art

During the past several years it has been possible to obtain a type of fluorescent lighting product that exhibits one of the key aspects of fixtures (namely that of being rigidly mountable) yet that can be readily and safely installed by a person of but ordinary skills. One example of such a product is the so-called Bright Stik, which is a self-ballasted fluorescent lamp made by the General Electric Company. This lamp can be mounted rigidly to a surface, such as to a wall or to the side or bottom of a kitchen cabinet.

However, when the lamp is worn out, it must be thrown away in its entirety; which implies undesirably high replacements costs.

SUMMARY OF THE INVENTION

Brief Description

The present invention is based on the recognition that, when powering fluorescent lamps with voltages or currents of relatively high frequencies—say, on the order of 20 kHz or higher—it becomes functionally advantageous and economically feasible to configure the lamp ballasting function in ways that are different from presently conventional practices.

For instance and according to the present invention, when powering fluorescent lamps from a regular power line, it is advantageous in many cases to provide the ballasting function in two stages: the one stage (hereinafter Stage 1) constituting a means for power line connection, frequency conversion, line isolation, current limiting and initial voltage transformation; the other stage (hereinafter Stage 2) constituting a means for providing cathode heating power, starting aid voltage and (optionally) further voltage transformation.

As a result of dividing the ballasting function into two stages as indicated, it becomes functionally attractive to associate Stage 1 closely with the source of power and Stage 2 closely with the fluorescent lamp—with the connection between the two stages accomplished by a single pair of conductors.

In the preferred embodiment, the present invention relates to a Rapid-Start fluorescent lamp with a built-in transformer means for providing cathode heating and lamp starting aid, with said transformer means deriving its input power from the relatively high frequency voltage provided across the lamp. Thus, with the cathode heating power and lamp starting aid derived from the voltage present across the lamp, it becomes possible to properly operate a Rapid-Start fluorescent lamp even if providing power to it by way of just a single pair of conductors —as compared with the two pairs of conductors normally required for such a lamp.

Since the power needed for the cathodes and the starting aid function is so very small, the size of the built-in transformer means need not be very large. In fact, for a single lamp with two cathodes of normal power requirements and with the voltage applied across the lamp being of a frequency around 20 kHz, the size of the requisite transformer means is under one cubic-centimeter (0.033 fluidounces) in volume; which is clearly small enough to represent but a trivial portion of the volume of the complete lamp.

To provide for proper lamp operation, the high frequency voltage applied across the lamp must be so constituted as to provide only a limited current (otherwise, the lamp would be destroyed); which therewith specifies the requirements of the part referred to as Stage 1 of the complete lamp ballasting function: Stage 1 must provide an open circuit voltage of a magnitude suitable for starting the lamp, while limiting the current to a level desirable for proper lamp operation. Specifically and by way of example, with a Rapid-Start lamp of approximately 24" length and 1.5" diameter—and without providing for any further voltage transformation in Stage 2 of the ballasting function—the voltage required for starting the lamp will be about 120 Volt RMS, and the voltage required for running the lamp will be about 60 Volt RMS at the typical lamp current of 0.4 Amp; which implies an effective internal impedance of the power supply of about 150 Ohm and a power output to the lamp of about 24 Watt.

Thus, a complete fluorescent lighting means built in accordance with the present invention would consist of a special Rapid-Start fluorescent lamp as described above and a high frequency current-limited power supply. In an anticipated typical arrangement, the lamp would be outfitted with means for non-fixtured mounting in fashion similar to that of a "Bright Stik"; and it would be powered by way of a regular two-wire cord coming from a plug means suitable for insertion directly into a normal power line receptacle. This plug means would contain the indicated frequency conversion, line isolation and voltage transformation means.

DESCRIPTION OF THE EMBODIMENTS

Figure 1:
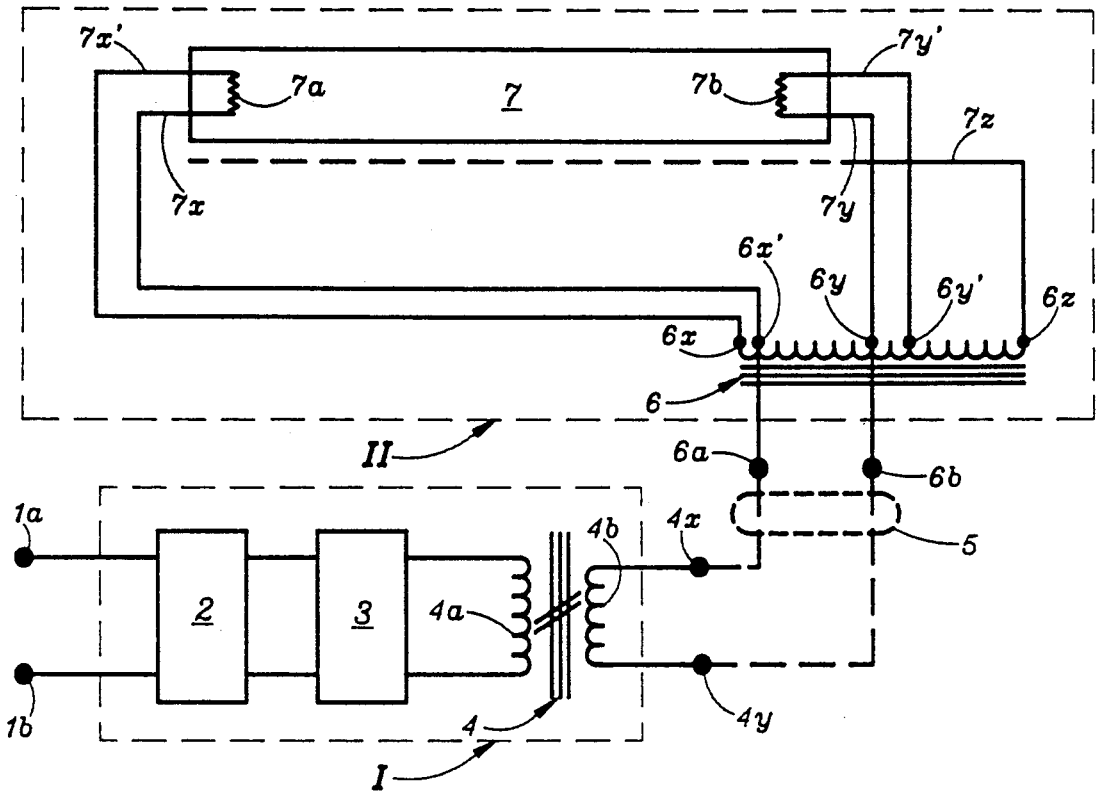
FIG. 1 is a schematic diagram representing the preferred embodiment of the invention.

The preferred embodiment of the present invention is illustrated by FIG. 1 and consists of two main subassemblies referred to as I and II.

Sub-assembly I (which corresponds to Stage 1 of the complete ballasting arrangement, as per previous definition) is connected to a source of regular power line AC voltage at a pair of input terminals 1*a* and 1*b*. The AC voltage is rectified in a rectifier means 2, the DC voltage output from which is supplied to an inverter 3. The output from the inverter is an AC voltage of frequency much higher than that of the power line AC voltage input to terminals 1*a* and 1*b*.

The output from the inverter is applied to the primary winding 4A of a transformer 4. This transformer exhibits a relatively loose or soft magnetic coupling between it primary winding 4A and its secondary winding 4B, which implies that the output from the secondary winding is limited in current—the current limitation being a function of the degree of looseness or softness in the primary-to-secondary coupling.

The output from the transformer secondary winding 4B represents the output of sub-assembly I and is provided across terminals 4*x* and 4*y*.

The output from terminals 4*x* and 4*y* of sub-assembly I is applied through a pair of wires 5 to sub-assembly II at its input terminals 6*a* and 6*b*—these input terminals 6*a* and 6*b* also being the input terminals to an auto-transformer 6 (which corresponds to Stage 2 of the total ballasting circuit) that is contained within sub-assembly II. The outputs from this auto-transformer are provided at terminals 6*x* and 6*x*', 6*y* and 6*y*', and 6*z*. The output from transformer terminals 6*x* and 6*x*' is connected with input terminals 7*x* and 7*x*' of cathode 7A of fluorescent lamp 7; and the output from transformer terminals 6*y* and 6*y*' is fluorescent lamp 7. The output from transformer terminal 6*z* is connected with lamp starting aid electrode 7*z*.

The operation of the preferred embodiment illustrated by FIG. 1 may be explained as follows.

Regular power line AC voltage of relatively low frequency (typically 120 Volt at 60 Hz) is applied to terminals 1*a* and 1*b*, and is converted to a unidirectional voltage by rectifier means 2. This unidirectional voltage is then applied to the inverter 3, which inverter may be of a type as described in my U.S. Pat. No. 4,148,128 entitled "High Efficiency Push-Pull Inverters".

The inverter changes this unidirectional input voltage to an alternating output voltage of relatively high frequency (typically at least 20 kHz) and substantially squarewave nature, said output voltage being provided by inverter 3 to the input winding 4A of the transformer 4. By virtue of the relatively loose or soft coupling between its primary winding 4A and its secondary winding 4B, transformer 4 provides an output across terminals 4*x* and 4*y* that is relatively limited in current availability.

This loose or soft coupling is typically obtained by providing a substantial magnetic flux leakage path in shunt between the transformer primary and secondary windings; which shunt leakage path gives rise to a relatively high output impedance at the transformer output terminals 4*x* and 4*y*; and which high output impedance, in turn, gives rise to the relatively limited current availability.

The relatively high frequency AC voltage from output terminals 4*x* and 4*y* of sub-assembly I is connected to the input terminals 6*a* and 6*b* of sub-assembly II, and thereby provides a proportional voltage across each of the lamp cathodes 7A and B, as well as between those cathodes and the lamp starting aid electrode 7*z*.

The voltage provided to the said cathodes is large enough to cause them to reach incandescence extra rapidly, and—in combination with the voltage provided at the starting aid electrode 7*z*—to permit the lamp to be started and operated in the so-called Rapid-Start mode. Typical cathode heating voltage before significant lamp current starts flowing is about 7.2 Volt, and a typical voltage required at the starting aid electrode is about 250 Volt.

After the indicated voltages have been applied to the fluorescent lamp 7 for a brief period—say, on the order of half a second—the cathodes will reach incandescence and gas discharge lamp current will begin to flow. The flow of lamp current will substantially load the output of sub-assembly I and (because of the said substantial output impedance of transformer 4) thereby cause its output voltage to drop—typically to about half of the magnitude existing before lamp current starts flowing.

However, the corresponding drop in cathode and starting aid voltages has substantially no effect on lamp operation—as long as the cathode voltages are kept within a range sufficient to prevent premature cathode failure. Typically, the voltage on each cathode after lamp current has started to flow is about 3.6 Volt.

Figure 2:
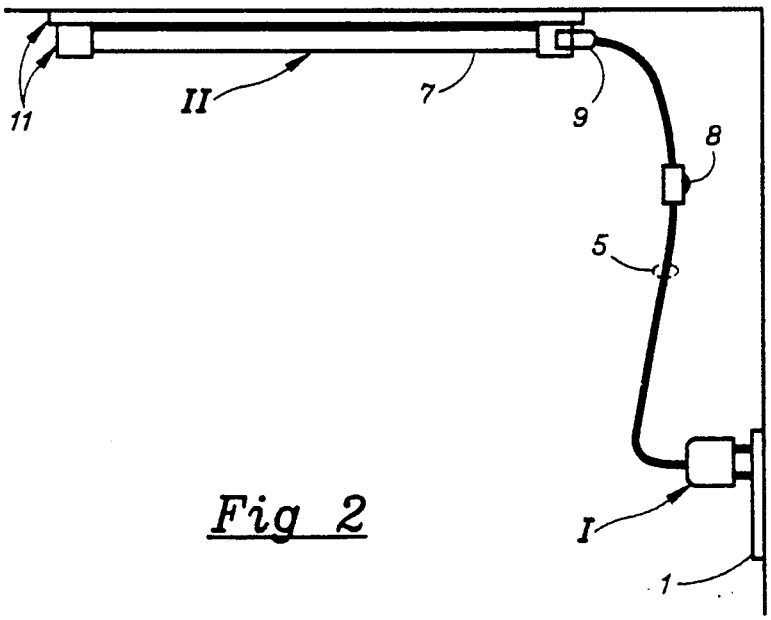
FIG. 2 is a schematic diagram illustrating an anticipated typical installation of this preferred embodiment.

FIG. 2 shows an arrangement illustrating an anticipated typical application situation involving the lamp and ballast combination of FIG. 1.

Sub-assembly I is built into a case or a box with a pair of terminals suitable for plugging directly into a regular power line receptacle 1. The output from sub-assembly I is provided by way of a pair of wires 5 within a cord on which is mounted a cord-switch 8, said cord-switch being capable of making and/or breaking the electrical connection between sub-assemblies I and II. At the end of cord 5 is mounted a two-prong female plug means 9, which constitutes and provides the two output terminals 4*x* and 4*y* from sub-assembly I, and which is capable of mating with a corresponding male receptacle on sub-assembly II. This male receptacle provides for connection with input terminals 6*a* and 6*b* of sub-assembly II.

Cord-switch 8 mounted on the cord containing the pair of wires 5 that connects sub-assemblies I and II is useful for switching the fluorescent lamp 7 ON or OFF while sub-assembly I is left plugged into the power line. Leaving sub-assembly I plugged into the power line on a permanent or semi-permanent basis is permissible to do since this sub-assembly consumes very little power—typically only a fraction of one watt—as long as sub-assembly II is switched OFF with switch 8.

Sub-assembly II is mounted on and/or within a structure such as to allow it to be removably mounted on a substantially flat surface, such as typically under a kitchen cabinet. Thus, it would have an appearance similar to that of a "Bright Stik" type of a product. However, the particular product herein shown has a number of advantages as compared with existing types of "Bright Stik" products.

One such advantage relates to the fact that the fluorescent lamp—which in effect constitutes sub-assembly II—is replaceable separately and independently of its ballasting means. This is so because sub-assembly II is disconnectable from sub-assembly I with the female plug means 9.

Another such advantage is the fact that—in contrast with regular "Bright Stik" type of products—the cord (5) and the lamp (sub-assembly II) are both totally isolated from the power line; which fact implies substantially improved product safety due to the much reduced electric shock hazard.

Yet another such advantage relates to the fact that—contrary to the case with existing "Bright Stik" type of products —nearly any length and size of fluorescent lamp may be used with the ballasting system herein disclosed. This is so because of the nearly unlimited range of output voltage, output current, and output impedance characteristics that can be designed into sub-assembly I; while the "Bright Stik" type of lamps are limited to working directly on the power line voltage.

Still another advantage is connected with the fact that the cathodes of the fluorescent lamp in sub-assembly II are provided with an initially very high voltage, which provides for very rapid cathode heating. Yet, as soon as the cathodes are hot enough for adequate electron emission and lamp current starts to flow, the cathode voltages immediately drop by a factor of approximately two-to-one. This implies that it is permissible to use a Rapid-Start fluorescent lamp in sub-assembly II, and to do the initial cathode heating with a voltage about twice as high as would normally be specified; which, in turn, results in the indicated very rapid cathode heating.

Nevertheless, the cathodes will not overheat since, as soon as they are hot enough for electron emission, the lamp will ignite; which then will automatically bring the cathode heating voltage down to normal level. Thus, when turned on, the lamp of sub-assembly II will start just about as fast as an Instant-Start fluorescent lamp; yet it will exhibit the extra long life characteristics normally associated with a Rapid-Start fluorescent lamp.

And, finally, a significant implicit advantage of the fluorescent lamp ballasting arrangement herein disclosed (see FIG. 1) relates to the fact that the output voltage from sub-assembly I can effectively be chosen to be much lower than the voltages normally present on power lines; which implies the potential of providing a voltage at the sub-assembly I output terminals 4*x* and 4*y* that is so low as to be substantially safe from any kind of electric shock hazard.

Figure 3:
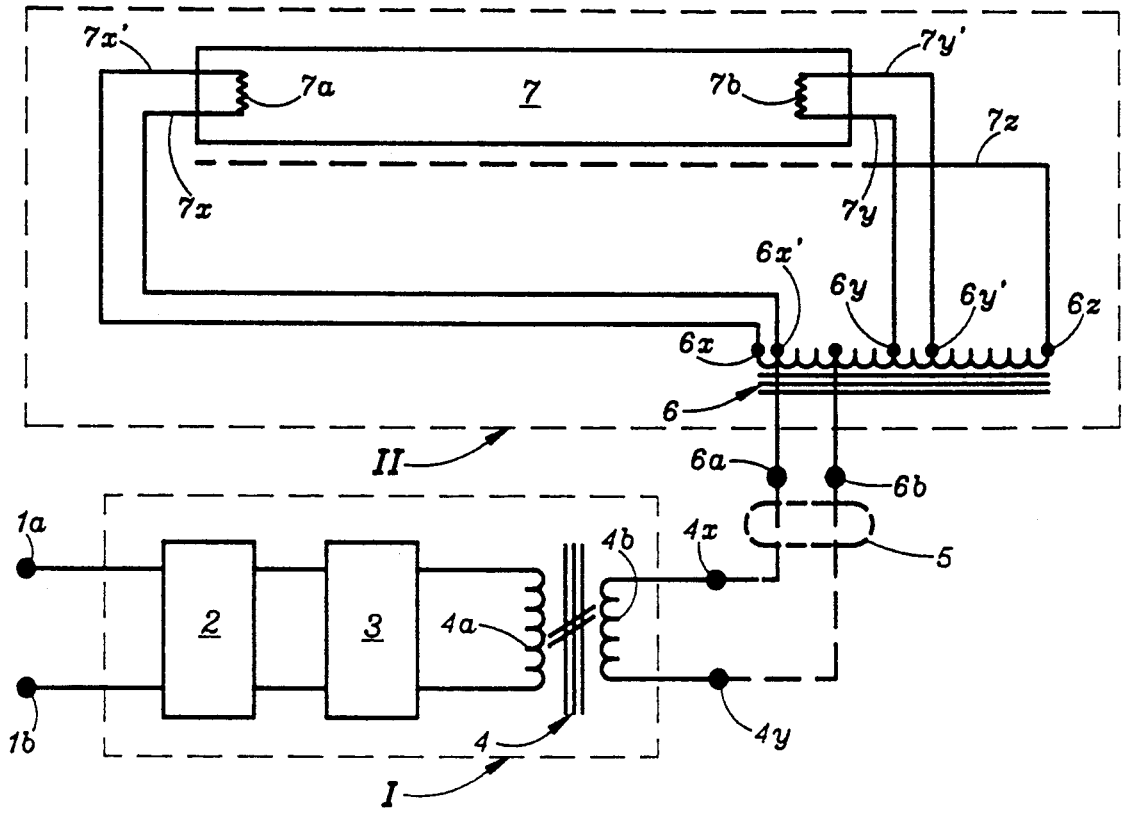
FIG. 3 is a schematic diagram representing an alternative embodiment of the invention.

FIG. 3 illustrates an arrangement designed to provide for the situation where the sub-assembly I output voltage is chosen to be relatively low. In fact, the FIG. 3 arrangement is identical to that of FIG. 1 except for the item marked X; which indicates in the arrangement of FIG. 3 that transformer 6 is arranged to provide a transformation of the main lamp voltage in addition to providing the required cathode and lamp starting aid voltages. This then implies that the voltage provided by sub-assembly I need not be the voltage directly required by the fluorescent lamp, but may be higher or lower—as required.

As a result of the additional power handling requirement, the size of transformer 6 will have to be increased—the degree of increase in size being dependent on the degree of voltage transformation required. However, at the typical frequencies herein considered (on the order of 20 kHz or higher) and even with the most drastic degree of voltage transformation, the physical size of transformer 6 would still be very small in comparison with the size of the fluorescent lamp.

Figure 4:
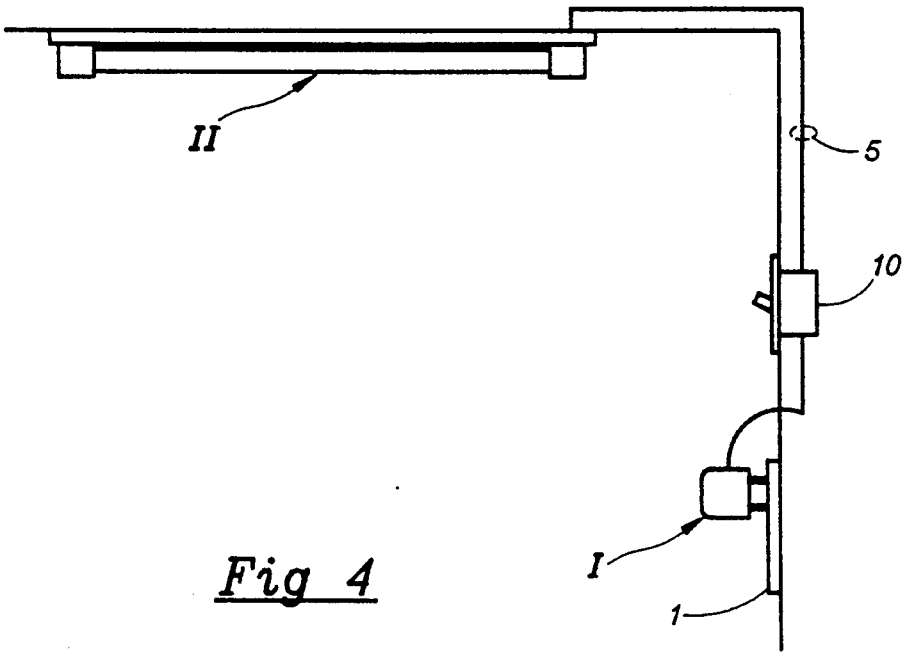
FIG. 4 is a schematic diagram illustrating an anticipated typical installation of this alternative embodiment.

FIG. 4 shows an arrangement illustrating an anticipated typical useage situation involving the lamp and ballast combination of FIG. 3.

In this case, just as in the FIG. 2 situation, sub-assembly I is built into a case or box with a pair of terminals suitable for plugging directly into a regular power line receptacle. The significant difference between the two situations relates to the fact that the voltage output from sub-assembly I is lower in the FIG. 4 case (typically lower than 30 Volt RMS); which, as long as the maximum current available is also kept low (typically under 8 Amp RMS), implies that the pair of wires 5 can safely be light gauge bell wires—even if, as illustrated, the pair of wires is permanently installed within a wall.

Moreover, because of the limited voltage and power supplied to sub-assembly II, the fluorescent lamp can safely be installed as a permanent fixture—even if arrangements are made to provide for easy lamp replacement.

With reference to both embodiments and all four figures of the specifications of the present invention, the following notations are made.

There is no need for sub-assembly II to comprise only a single fluorescent lamp. The principles herein described clearly permit sub-assembly II to comprise any number of lamps.

The fluorescent lamp (or lamps) of sub-assembly II can be arranged to be removably mounted therein. Thus, sub-assembly II may readily be configured as a re-lampable fluorescent lamp holder or fixture.

Sub-assembly II does not necessarily need to be mounted on a substantially flat surface. For instance, another attractive way of using said sub-assembly—especially when more than a single fluorescent lamp is used therein—is that of having it hung over a workbench, as a so-called shop-light; in which case appropriate means to facilitate such hanging can readily be provided as part of the structure holding the lamp(s).

In addition, the following comments and definitions are provided.

a) In accordance with general industry usage, the term "fluorescent lamp" refers to an entity that: i) is capable of providing light output by means of fluorescence, and ii) constitutes a complete integral entity having no removable and/or servicable parts.

Hence, at the end of its useful life, a fluorescent lamp is non-functional and non-repairable, and is normally thrown away. That is, a fluorescent lamp is a replaceable product; or —stated differently—it is a consumable product that is simply discarded at the end of its useful life. Hence, a fluorescent lamp is a so-called throw-away product.

b) A fluorescent lamp may comprise various built-in or integral features. For instance, it may comprise its own built-in ballasting means, as does the Bright Stik from General Electric.

Or, a so-called Rapid-Start fluorescent lamp may comprise its own built-in means to provide continuous low voltage for heating its cathodes (which low voltage could be derived from the relatively high voltage present between the lamp cathodes) instead of receiving such low voltage from a source external of the lamp—which is the way it is normally done.

c) In view of the definition of fluorescent lamp provided in a) above, as long as fluorescent lamp 7 of FIG. 1 is non-removable from sub-assembly II (which is indeed the case for the embodiments shown), and as long as no other parts of sub-assembly II is servicable or removable, the whole sub-assembly can itself be properly- regarded as a fluorescent lamp.

Hence, sub-assembly II of FIGS. 1 and 2 constitutes a fluorescent lamp having built-in means for providing its own low voltage for cathode heating as well as its own built-in starting aid electrode and means for providing starting aid voltage.

Likewise, sub-assembly II of FIGS. 3 and 4 constitutes a fluorescent lamp having all the built-in features of sub-assembly II of FIGS. 1 and 2, but additionally comprises built-in means for transforming the magnitude of its main operating voltage.

d) In sub-assembly I of FIG. 1, rectifier means 2 and inverter 3 are both of totally ordinary construction; which implies that rectification and inversion both take place without incurring substantial power dissipation. In a typical situation, the overall combined efficiency of the rectifier means and the inverter will be in excess of 90%.

If there is no load connected at the output of sub-assembly I, substantially no power dissipation takes place within the sub-assembly, even if the sub-assembly is connected to the power line. This feature is very important in that it makes it practicable to locate a switch in the position between the special power-plug (i.e., sub-assembly I) and the special fluorescent lamp (i.e., sub-assembly II), as illustrated by switch 8 mounted on cord 5, both of FIG. 2.

Also, it should be noted that the limitation of the current available from the output of sub-assembly I is achieved by way of inductive reactance means; which implies that it is achieved without causing power dissipation. Thus, for instance, if the output terminals of sub-assembly I were to be short-circuited, no substantial power dissipation would result; and the short-circuited condition could go on indefinitely without causing damage or significant energy waste.

e) Sub-assembly I can readily be made to conform to the specifications of so-called Class-2 and/or Class-3 power supplies; both of which types of power supplies are defined under the National Electrical Code as being substantially free from fire-initiation hazard. Class-2 power supplies are additionally defined as being substantially free from electric shock hazard.

f) In the context of lighting systems, the terms "fixture", "luminaire", "light fitting", "lamp holder" and "lamp socket" are herewith defined—in accordance with common industry usage —as products intended for receiving and detachably holding one or more "lamps", where—again in line with industry usage as well as with the definition of "fluorescent lamp" in section a) above—the term "lamps" refer to entities capable of providing light output, each of which entities constitutes an integral replaceable (throw-away) item without any removable and/or servicable parts. Hence, to be useful, a fixture (or luminaire, etc.) needs a lamp. However, a lamp does not necessarily need a fixture (or luminaire, etc.) to be useful.

g) Similarly, the term "portable lamp" refers to a lighting product intended for plug-in connection with an ordinary electric receptacle. A portable lamp would normally comprise a lamp socket means and a replaceable lamp. Typical examples of a portable lamp are so-called table lamps and floor lamps.

However, even though it does not comprise a lamp socket of any ordinary type, the product or system represented by the combination of sub-assemblies I and II of FIG. 2 is such a portable lamp. Of course, it might well be argued that the female plug means 9 is indeed a lamp socket.

h) Sub-assembly II of FIG. 2 is a fluorescent lamp—in complete accordance with definition of a) above—that can be used without having to be placed in a fixture or in any other ordinary lamp holder. As indicated by item 11 in FIG. 2, this lamp integrally comprises a re-inforcing and protective back structure and protective end-caps (just like the General Electric Bright Stik), thereby permitting this lamp to be safely mounted directly onto flat surface without the need for additional supportive or protective means—except for a couple of pieces of mounting tape and/or a couple of screws.

i) With reference to paragraph e) above, as would be well understood by a person possessing but ordinary skill in the art pertinent hereto, to actually make Sub-Assembly I conform to the specifications of Class-3 power supplies: (i) the number of turns on secondary winding 4B of transformer 4 should be so chosen as to make the RMS magnitude of the AC voltage provided across this secondary winding be lower than about 150 Volt; and (ii) the magnetic coupling between primary winding 4A and the secondary winding should be made sufficiently loose to prevent the maximum power capable of being supplied from the secondary winding from exceeding about 100 Watt. To make Sub-Assembly I also conform to the Class-2 specifications, it is necessary—by further reducing the number of turns on the secondary winding —to limit the RMS magnitude of the voltage provided from the secondary winding to about 30 Volt.

It is believed that the present invention and its attendant features and advantages will be understood from the foregoing description. However, many changes may be made in the forms, constructions and/or interconnections of its component parts, those herein described merely representing the presently preferred embodiments of the invention.

I claim:

1. An arrangement comprising:

power plug means operative by way of a pair of electrical power prongs to be plugged into and to be held by an ordinary household electrical receptacle; the plug means having built-in frequency-conversion means connected with the prongs and operative to provide a high-frequency voltage from a pair of source terminals; the high-frequency voltage being of frequency substantially higher than that of the voltage normally present on an ordinary electric utility power line; an inductive reactance being connected with the source terminals and operative to manifestly limit the magnitude of any current supplied from the source terminals; the frequency-conversion means having internal power dissipation that is: (i) of negligible magnitude as long as no current is being drawn from the source terminals; and (ii) of small magnitude compared with the magnitude of any substantive amount of power being drawn from the source terminals; and gas discharge lamp means disposed some distance apart from the plug means and disconnectably connected with the source terminals thereof by way of flexible cord means; the gas discharge lamp means thus being provided with said high-frequency voltage, thereby to draw a lamp current.

2. The arrangement of claim 1 wherein the maximum power that may be drawn from the source terminals is so limited as to be substantially safe from fire initiation hazard.

3. The arrangement of claim 1 wherein said high-frequency voltage is limited in magnitude to such a degree as to be substantially safe from electrical shock hazard yet capable of igniting and operating the gas discharge lamp means.

4. The arrangement of claim 1 wherein the gas discharge lamp means includes: (i) a thermionic cathode having cathode terminals; and (ii) cathode heating means connected with the cathode terminals and operative to provide cathode heating power to the thermionic cathode as long as the gas discharge lamp means is indeed connected with the source terminals by way of said cored means.

5. The arrangement of claim 1 wherein: (i) the gas discharge lamp means includes two thermionic cathodes; (ii) each cathode has a lamp terminal; (iii) a lamp operating voltage is provided across the lamp terminals; and (iv) the gas discharge lamp means includes a transformation means connected with the lamp terminals and operative to cause the magnitude of the lamp operating voltage to be of magnitude larger than that of the magnitude-limited high-frequency voltage provided to the transformation means from the output by way of the electrical cord and the connect means.

6. An arrangement comprising:

power plug means operative by way of a pair of electrical power prongs to be plugged into and to be held by an ordinary household electrical receptacle; the plug means having built-in frequency-conversion means connected with the prongs and operative to provide a high-frequency voltage from a pair of source terminals; the voltage being of frequency substantially higher than that of the voltage normally present on an ordinary electric utility power line; the frequency conversion means having: (i) an inverter operative to provide a substantially squarewave voltage at a pair of inverter output terminals as well as to supply an inverter output current from these inverter output terminals; and (ii) current-limiting means connected between the inverter output terminals and the source terminals, the current-limiting means being operative to limit the magnitude of any current supplied to the source terminals; and gas discharge lamp means disposed some distance apart from the plug means and disconnectably connected with the source terminals thereof by way of flexible cord means; the gas discharge lamp means thereby being supplied with a lamp current;

the arrangement being so constituted that the inverter output current will be of substantive magnitude only when the gas discharge means is being supplied with the lamp current.

7. The arrangement of claim 6 wherein the current-limiting means includes a transformer means having a primary winding and a secondary winding; which secondary winding is only loosely coupled with the primary winding.

8. The arrangement of claim 6 wherein the gas discharge lamp means includes voltage transformation means.

9. The arrangement of claim 6 wherein the magnitude of the inverter output current is substantially proportional to the magnitude of the lamp current.

10. An arrangement comprising:

power plug means operative by way of a pair of electrical power prongs to be plugged into and to be held by an ordinary household electrical receptacle; the plug means having built-in frequency-conversion means connected with the prongs and operative to provide a high-frequency voltage from a pair of source terminals; the high-frequency voltage being of frequency substantially higher than that of the voltage normally present on an ordinary electric utility power line; the frequency conversion means having: (i) rectifier means connected with the power prongs and operative to provide a DC voltage at a pair of DC terminals; (ii) inverter means connected with the DC terminals and operative to provide a substantially squarewave voltage at a pair of inverter output terminals as well as to conditionally supply an inverter output current from these inverter output terminals; and (iii) current-limiting means connected between the inverter output terminals and the source terminals, the current-limiting means being operative to limit the magnitude of any current supplied to the source terminals; and gas discharge lamp means disposed some distance apart from the plug means and disconnectably connected with the source terminals thereof by way of flexible cord means; the gas discharge lamp means thereby being operative to draw a substantive amount of power from the source terminals;

the arrangement being so constituted that the inverter output current will be of substantive magnitude only when a substantive amount of power is being drawn from the source terminals.

11. The arrangement of claim 10 wherein: (i) the gas discharge lamp means draws a lamp current; and (ii) the magnitude of the inverter output current is substantially proportional to the magnitude of the lamp current.

12. The arrangement of claim 10 wherein, whenever the gas discharge lamp means is disconnected from the source terminals, the inverter output current is of negligible magnitude.

13. An arrangement comprising:

power plug means operative by way of a pair of electrical power prongs to be plugged into and to be held by an ordinary household electrical receptacle; the plug means having built-in frequency-conversion means connected with the prongs and operative to provide a high-frequency voltage at a pair of source terminals; the high-frequency voltage being of frequency substantially higher than that of the voltage normally present on an ordinary electric utility power line; an inductive reactance being connected with the source terminals and operative to manifestly limit the magnitude of any current supplied from the source terminals; the frequency-conversion means having internal power dissipation that is: (i) of negligible magnitude as long as no current is being drawn from the source terminals; and (ii) of small magnitude compared with the magnitude of any substantive amount of power being drawn from the source terminals; and gas discharge lamp means disposed some distance apart from the plug means and disconnectably connected with the source terminals thereof by way of flexible cord means; the gas discharge lamp means, when indeed being connected with the source terminals, thereby being provided with said high-frequency voltage;

the arrangement being so constituted that no current flows from the source terminals except when the gas discharge lamp means is connected therewith.

* * * * *